US005520354A

United States Patent [19]

Adamski

[11] Patent Number: 5,520,354

[45] Date of Patent: May 28, 1996

[54] REEL FOR A PAPERMAKING MACHINE

[75] Inventor: Brian C. Adamski, Edgerton, Wis.

[73] Assignee: Beloit Technologies, Inc., Wilmington, Del.

[21] Appl. No.: 405,575

[22] Filed: Mar. 16, 1995

Related U.S. Application Data

[63] Continuation of Ser. No. 13,530, Feb. 4, 1993, abandoned.

[51] Int. Cl.[6] ..... B65H 18/16

[52] U.S. Cl. ..... 242/541.1

[58] Field of Search ..... 242/65, 66, 67.1 R, 242/541.1

[56] References Cited

U.S. PATENT DOCUMENTS

| | | | |
|---|---|---|---|
| 3,202,374 | 8/1965 | Phelps . | |
| 4,179,330 | 12/1979 | Page | 242/65 X |
| 5,064,131 | 11/1991 | Van Biesen et al. . | |
| 5,083,719 | 1/1992 | Kremar . | |
| 5,184,787 | 2/1993 | Holzinger . | |
| 5,261,620 | 11/1993 | Holzinger et al. . | |

FOREIGN PATENT DOCUMENTS

| | | |
|---|---|---|
| 2012733 | 8/1979 | United Kingdom . |

*Primary Examiner*—John P. Darling
*Attorney, Agent, or Firm*—Dirk J. Veneman; Raymond W. Campbell; Gerald A. Mathews

[57] ABSTRACT

A Pope-type reel for use on a papermaking machine to wind a substantially continuous, traveling paper web into successive wound paper rolls has a primary drive stand which pivots co-axially with the rotational axis of the reel support drum. A primary reel spool drive is mounted to the primary drive stand to provide torque to the reel spool from the initial winding of the traveling paper web onto the reel spool while it is supported by a pair of primary arms over the upper periphery of the support drum until the reel spool is rotated downwardly by the primary arms onto a pair of horizontal guide rails. At this time, the reel spool drive is disengaged, and a secondary reel spool drive engages the now partially wound web roll to provide torque continually until the paper web roll is completely wound.

3 Claims, 4 Drawing Sheets

REEL FOR A PAPERMAKING MACHINE

This is a continuation of application Ser. No. 08/013,530 filed on Feb. 4, 1993 now abandoned.

BACKGROUND OF THE INVENTION

1. Field of the Invention

This invention relates to a reel for winding a traveling, substantially continuous web. More particularly, this invention relates to a reel for winding the paper sheet produced on a papermaking machine. Still more particularly, this invention relates to an improved Pope-type reel on a papermaking machine. Such a reel incorporates a driven support drum about which a pair of primary arms are co-axially mounted. The primary arms accept a reel spool, bring it into engagement with the support drum at a location about the upper periphery thereof, and rotate the reel spool about the support drum and deposit it onto a pair of horizontally disposed guide rails. The paper sheet begins to be wound about the reel spool at its location about the upper periphery of the support drum and is wound into a partial wound paper roll by the time the reel spool is deposited onto the guide rails.

2. Description of the Prior Art

Wound paper rolls must be structured properly to avoid inducing web defects during the winding process. The so-called Pope-type reels, while mechanically effective, tend to produce wound rolls of paper where the paper wound near the reel spool, such as from about 5 cm to about 15 cm from the reel spool surface, is defective, such as by having so-called core bursts, wrinkles, tears or other defects generally related to excessive compression during the winding process. It is imperative that the initial web wraps on the core, or reel spool, are tight enough to avoid layer-to-layer slippage and bursting. However, the paper web cannot be wrapped too tightly since its wound-in tension cannot exceed the paper sheets' tensile strength.

In the paper web reeling process, the tension in the paper sheet of each successive layer tends to relieve the wound-in tension in the paper web beneath it. As the diameter of the wound paper roll increases, it has been determined that each successive web wrap on the roll should be wound with slightly less tension in order to minimize the reduction in the wound-in tension in the web layers beneath it.

Heretofore, in Pope-type reels, such control of the wound-in tension has been very difficult, if not impossible, to control since each new core, or reel spool, has been driven during the initial reeling stage, when the diameter of the wound paper roll is small, either by nipping contact with the support drum or by external contact with a nipped drive roll, such as a rubber covered tire, or both. In any event, the wound-in tension of the web on the new reel spool was provided essentially by the nipped frictional engagement of the reel spool against the support drum with the paper web in-between.

Therefore, during the period of time during the early states of the reeling process, when the newly formed wound paper roll is perhaps between about 5–15 cm in radial thickness, the wound-in tension is produced essentially by the frictional nipping engagement of the reel spool against the support drum. This is while the reel spool is supported by the primary arms over and against the upper periphery of the support drum. The wound-in tension produced this way is insufficient to prevent defects near the core, particularly when the wound paper rolls become large in diameter, such as about 250 cm or larger.

After the reel spool, with the initially wound layers of paper web on it, has been deposited on the guide rails in current Pope-type reels, a drive is connected to the reel spool to provide torque to drive the wound paper roll to provide the desired wound-in tension while the wound roll is held in nipping engagement with the driven support drum.

It has been determined that the three winding parameters influencing the desired hardness of wound paper rolls are 1) the linear nip pressure between the wound paper roll and the support drum; 2) the tension in the in-coming paper sheet; and 3) the torque applied to the reel spool/core of the paper roll being wound.

When nip pressure is the only wound web roll structuring technique utilized in producing the roll, there are limitations inherent in both the grades of paper which can be wound in this manner, and in the amount of nip pressure which can be effectively applied between the reel spool and support drum. For example, paper grades sensitive to nip pressure, such as creped and carbonless forms, cannot be wound at high nip pressures without adversely affecting the paper quality. Also, high nip pressures cannot effectively be applied to steel reel spools since steel spools do not possess sufficient compressibility, or ability to deform, to function properly in nipping engagement. Finally, low nip pressures alone will frequently not provide enough friction to drive the paper roll being wound.

Another limiting operational characteristic affecting the ability of current design Pope-type reels to wind a paper sheet effectively is that the range of tension in the in-coming paper sheet is limited to a relatively narrow range. Thus, while a greater sheet tension might be desired for the purposes of producing a more desirable roll structure, it might increase the frequency of sheet breaks and, therefore, not be feasible.

Another aspect of this design insures proper speed match between the spool and drum until the spool is brought into nipping contact with the drum. Conventional wind-ups use surface driving to accelerate the new spool to web speed. These drives lose contact with the spool prior to making nipping contact with the drum. An over-speeding or under-speeding spool causes web breaks during the web transfer.

Some mechanism have been designed to supply torque through the primary arm rotation in a Pope-type reel, such as shown and described in German document DE 40 07 329 A1. However, this apparatus is complicated, costly and might do more harm than good to the paper sheet being wound into a roll. Thus, in the German document apparatus, an expensive and complicated servo system positions the drive and reducer assembly relative to the winding core. The use of complicated sensors and hydraulic systems increase installation and maintenance costs. Failure of any component in the feedback loop could be hazardous to personnel, equipment and roll structure. Further, on conventional winding machines, the roll may require a 400 HP drive motor at one end of the reel spool. Over-hung weights approaching 12,000–13,000 pounds can be expected. This results in cross-machine nip pressure variants and spool deflection which cannot be avoided. In this regard, spool deflection alone can create sheet defects near the reel spool/core.

SUMMARY OF THE INVENTION

This invention improves upon the winding procedure in a Pope-type reel. This invention also substantially eliminates or minimizes the undesirable and deleterious aspects associated with insufficient wound-in tension of the paper sheet around the reel spool during the early stages of the reeling process when the wound paper roll is relatively small in diameter.

In this invention, two different torque drives are applied to the reel spool, or core, during the reeling process. A unique pivoting platform, or primary drive stand, is mounted at one end of the apparatus to engage a reel spool soon after the reel spool is initially received by the primary reel arms and brought into proximity to the support drum to begin reeling the on-coming paper web into a roll of paper. The primary drive stand is mounted to rotate co-axially with the reels' support drum and primary arms. It is linked with a motor for driving a shaft which is connected to the new reel spool through a flexible coupling. This permits torque to be applied to the reel spool prior to the web winding process when the new reel spool is held by the primary arms and accelerated to web speed at a location spaced above the upper surface of the support drum. The drive remains engaged to the spool while bringing it into nipping contact with the drum, insuring proper speed match between the spool and drum. The traveling paper web is thereby wound with the desired tension onto the new reel spool, and the primary arms subsequently rotate the reel spool over the upper periphery of the support drum and, at some point, bring the reel spool with the initial wraps of paper web on it into nipping engagement with the support drum. The reel spool with the initial stages of the wound paper web on it then continues to be pivoted downwardly over the surface of the support drum while torque is continuously applied by the driven coupling which pivots to follow the reel spool in its path over the support drum. At all times during this arcuate path of travel over the support drum, torque is applied to the reel spool/core to wind the paper web with a desired tension.

When the reel spool reaches the substantially horizontally disposed guide rails, the driven shaft on the primary drive stand is disengaged from the reel spool through its flexible coupling, and a secondary drive engages the reel spool to continue to supply torque to the paper roll as it is being wound. The paper roll continues to be engaged with the support drum along a nip line of contact therebetween, and the secondary drive follows the path of the wound paper roll as it moves radially outwardly from the support drum along the guide rails.

This invention, therefore, provides torque to the reel spool from the time when the traveling paper initially contacts the newly positioned reel spool in the primary arms until the paper roll is wound to the desired diameter on the guide rails. The wound-in tension in the paper sheet is, therefore, controlled at all times during the reeling process.

In addition, nip pressure of the paper roll being wound during the period when it is supported on the surface of the support drum is controlled through two cylinders mounted in opposed array in each of the primary arms. One cylinder maintains the desired nip pressure level between the developing wound paper roll and the support drum. The second cylinder, commonly termed the nip-relieving cylinder, is activated when the weight of the wound roll is excessive to provide the desired nip. At increased weights, it relieves the reel spool/core weight to maintain the desired nip pressure during its arcuate path of travel while supported over an upper arcuate segment of the support drum surface. Such nip pressure control is optional as desired or required.

In this manner, both the torque and the nip applied to the reel spool, and the newly formed paper roll being wound on it, are controlled from the very beginning of the paper winding process.

Accordingly, it is an object of this invention to provide a Pope-type papermaking machine reel capable of reeling a wound roll of paper having the desired roll hardness without requiring excessive nip at the beginning of the paper web winding process.

Another object of this invention is to provide an improved Pope-type papermaking machine reel which improves the amount of saleable paper in a wound paper roll produced by the reel.

Another object, feature and advantage of this invention is the provision of a Pope-type papermaking machine reel wherein torque is applied to the reel spool from the beginning of the paper web reeling process.

Yet another object, feature and advantage of this invention is to provide a Pope-type papermaking machine reel having two drive mechanisms which are separately used to drive the reel spool during the entire paper web reeling process.

Yet another object of this invention is to provide a papermaking machine reel which produces a wound paper roll having reduced defects near the wound roll core.

These, and other objects, features and advantages of this invention, will become readily apparent to those skilled in the art upon reading the description of the preferred embodiment in conjunction with the drawings.

DESCRIPTION OF THE PREFERRED EMBODIMENT

Figure 2:
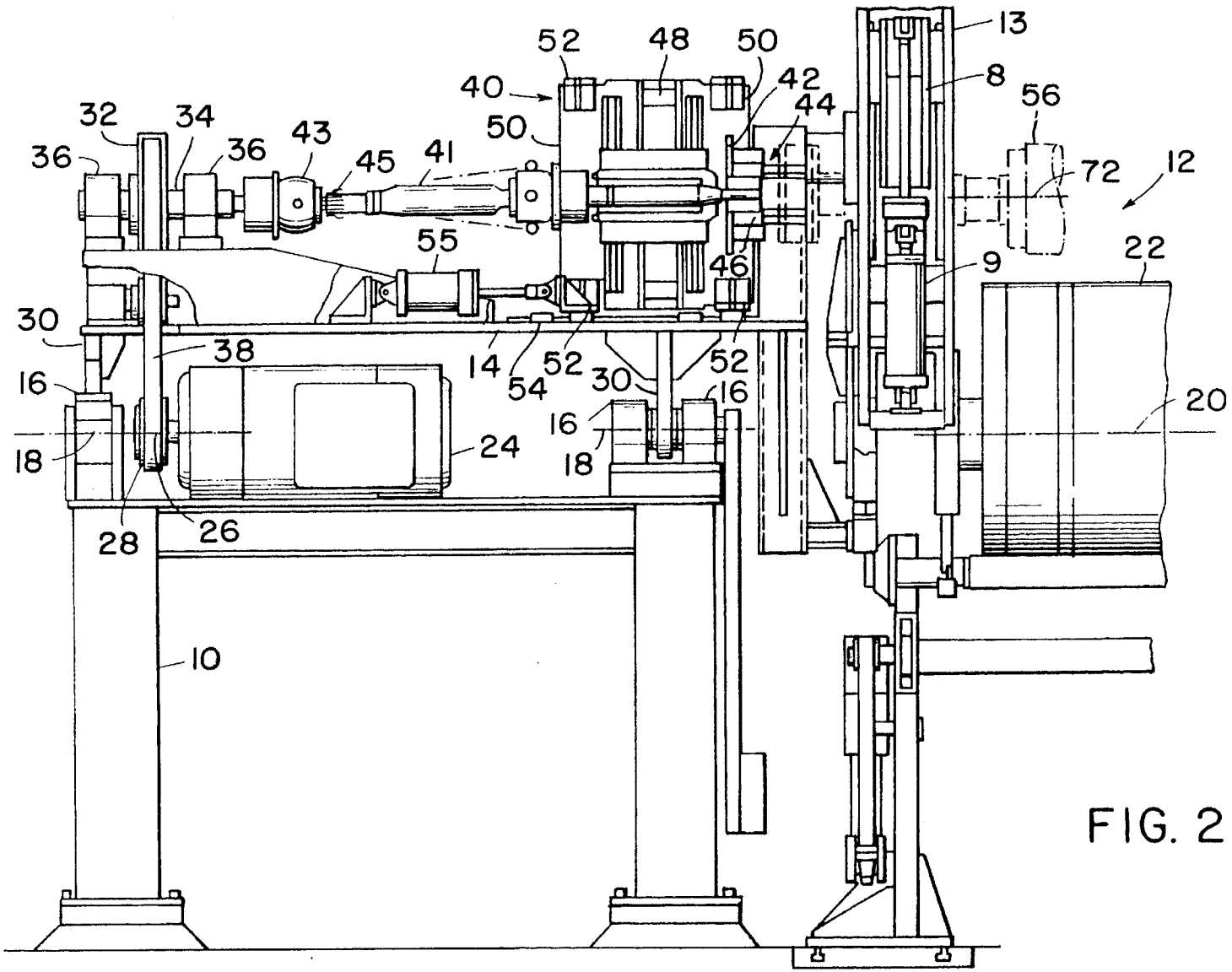
FIG. 2 is a more detailed front-elevational view of the primary drive apparatus for applying torque to the reel spool.

With reference to FIG. 2, a primary support stand 10 is mounted on the floor at the front side of the reel, which is generally designated with the numeral 12, on a papermaking machine. A platform 14 is mounted on the primary support stand with a plurality of bearings 16 so as to be pivotably about an axis 18 which is co-axial with the axis 20 of the support drum 22 in the reel. A motor 24 is mounted on the support stand with the axis 26 of its drive sheave 28 also co-axial with the axis 18 of rotation of the platform 14. The platform thus rotates about its aligned axes 18 on either end thereof about corresponding arms 30.

On the upper side of the platform 14 near one end is an in-shaft drive system comprising a drive sheave 32 mounted on a shaft 34 which is rotatably supported in bearings 36. The sheave 32 of the in-shaft drive system is aligned with the sheave 28 on the motor drive shaft, and the motor is thus connected to the in-shaft drive system by a timing belt 38.

Near the other end of the support stand closest the reel, and spaced from the in-shaft drive system, is a coupling apparatus, generally designated with the numeral 40, which is connected with the in-shaft drive system via a shaft 41.

The coupling apparatus 40 includes a female coupling half 42 and a male coupling half 44. The female coupling half is connected to a cam clutch 46 which, in turn, is actuated by a rodless pneumatic cylinder 48 which extends between a pair of mounting plates 50 which are held together by bolted cross members 52. The rodless cylinders also relieve the overhung weight of the shaft and coupling assembly. Linear bearings 54 permit reciprocal movement of the flexible coupling, by positioning cylinder 55, on which the female coupling half is mounted into, and out of, engagement with the male coupling half which is attached to the reel spool, or core, 56.

Figure 1:
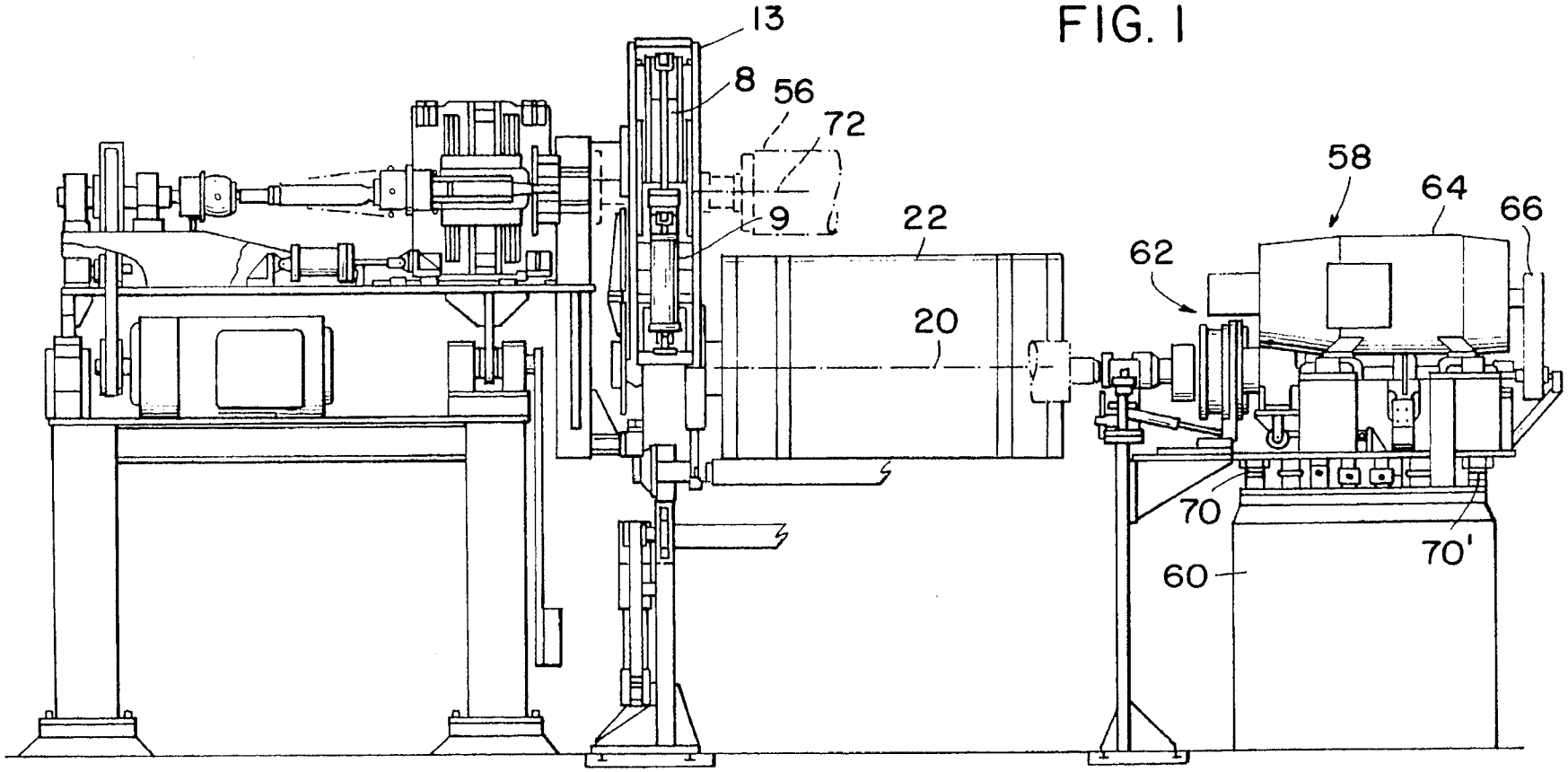
FIG. 1 is a front-elevational view showing a Pope-type reel with the core-driving primary drive apparatus at the left, on the front of the machine, and the core-driving secondary drive apparatus on the right, at the back of the machine.

As shown in FIG. 1, a secondary drive, generally designated by the numeral 58, is mounted on a secondary support stand 60. It is positioned so that its coupling 62 will permit the secondary drive motor 64 operating through drive belt 66 in much the same manner as described previously in conjunction with the primary drive apparatus, to engage the rear end of a reel spool when the reel spool with a partially wound paper roll is supported on a pair of spaced, parallel, horizontally disposed guide rails 68,68'.

The secondary drive apparatus is mounted on a pair of guide bars 70,70' which support the secondary drive apparatus for lateral movement parallel to the path of the axis 72 of the reel spool 56 as the reel spool rolls along the guide rails 68,68'.

Figure 3:
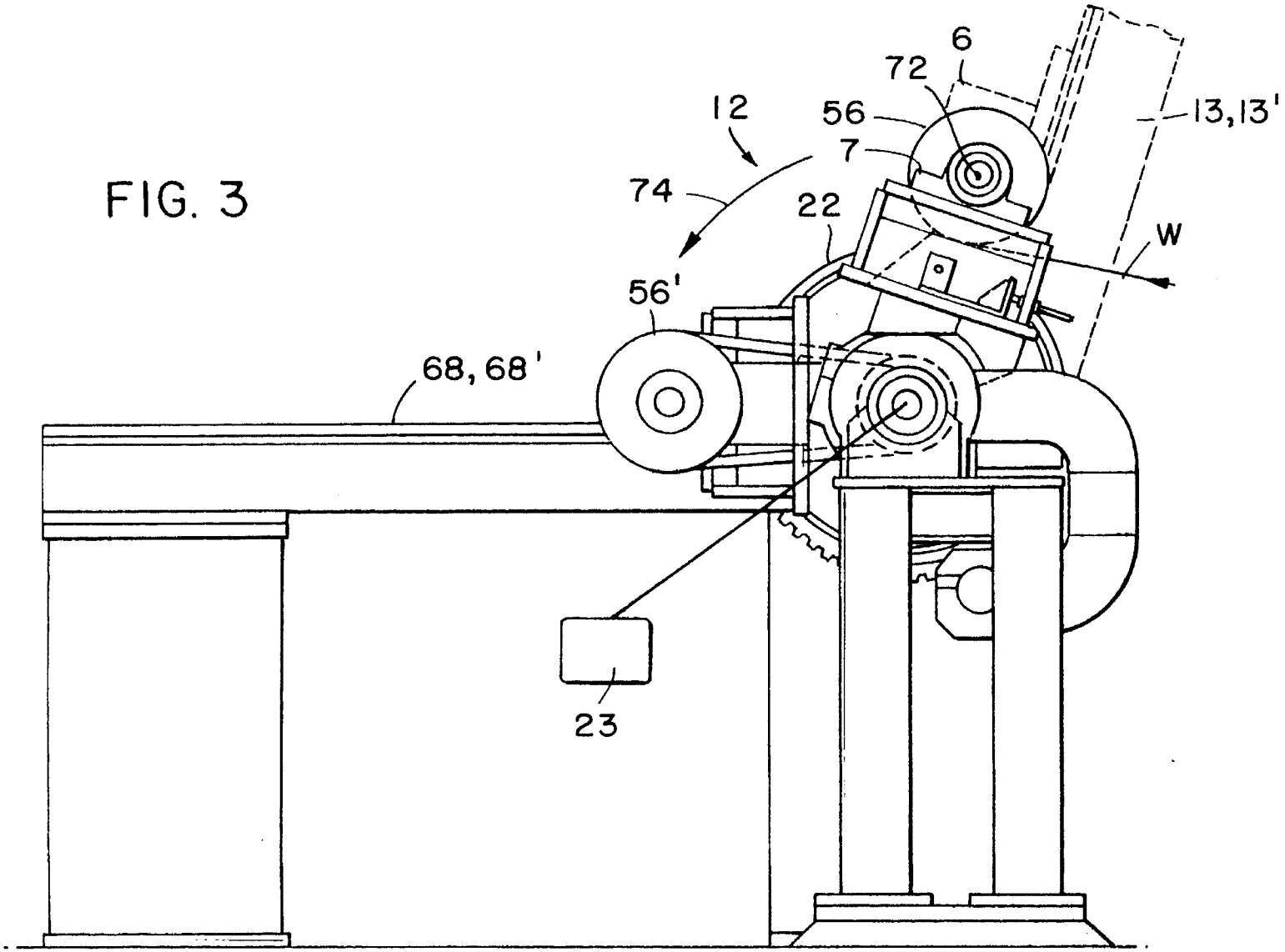
FIG. 3 is a side-elevational view of a Pope-type papermaking machine reel showing the primary arms and a reel spool in both its initial position, while held by the primary arms, and its subsequent position when it is supported on the horizontal guide rails. This view is somewhat schematic in form in that it does not show the web turn-up apparatus for guiding the web onto a new reel spool, nor does it show the secondary reel arms.

With reference to FIG. 3, a Pope-type papermaking machine reel 12 is shown with a pair of primary arms 13,13' in which a reel spool 56 is held in an initial position slightly spaced above the support drum 22 when the reel spool is initially loaded into a rotatably mounted position in the primary arms.

Although two reel spools are not operationally utilized in the reel apparatus at the same time, a reel spool 56' is also shown in its position supported on rails 68,68' to illustrate the position where the new reel spool mounted in the primary arms eventually is positioned. The reel support drum 22 is rotatably powered by a separate motor shown schematically at 23.

With reference to FIG. 2, within each of the primary arms 13,13', a pair of opposed cylinders 8,9 are mounted to provide nipping pressure force via cylinder 8, or nip-relieving pressure force, via cylinder 9. This permits the reel spool, or core, 56, which is rotatably clamped between upper and lower blocks 6,7 in the primary arms (FIG. 3) to be moved to nip the reel spool into nipping engagement with support drum as the primary arms rotate downwardly in the direction of arrow 74 as the new reel spool grows larger while the on-coming paper web is wrapped upon it.

Figure 4:
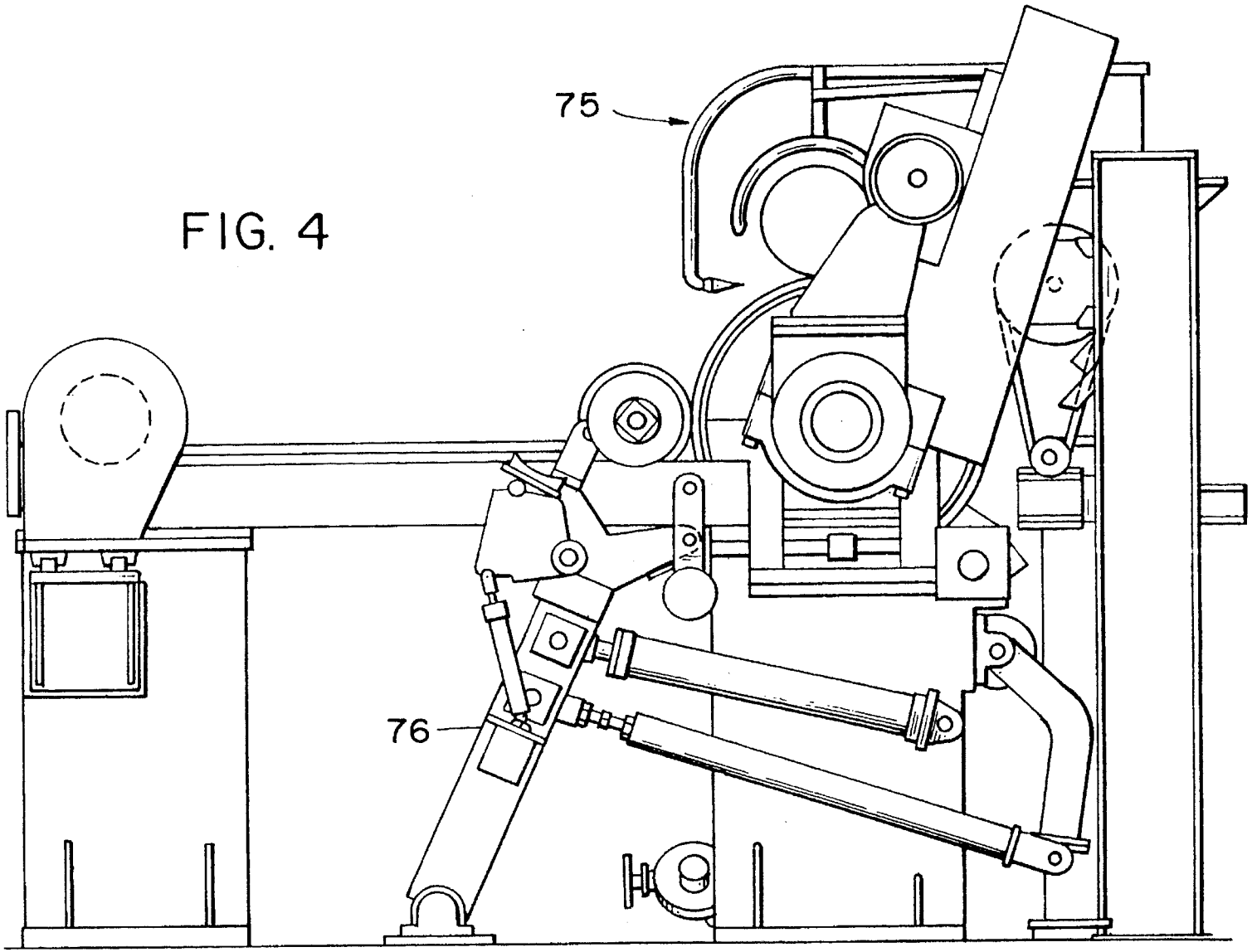
FIG. 4 is a side-elevational view of a Pope-type reel showing the secondary arms for engaging the reel spool as the web is wound thereon when the roll is supported on the guide rails.

The construction and operation of the Pope-type reel itself, as well as the secondary drive for applying torque drive to the wound paper roll supported on the guide rails, is known in the papermaking industry, so they will not be discussed in further detail except in conjunction with the construction and operation of the primary drive. Thus, the apparatus of the known Pope-type reel shown in FIG. 4, which shows the web turn-up apparatus 75 and secondary arm apparatus 76, which form no part of this invention, will not be discussed in further detail.

In operation, a new reel spool/core 56 is received in the upper and low core blocks 6,7 of the primary arms 13,13'. A traveling, on-coming paper web W is guided by web turn-up apparatus to be received onto the new reel spool, and the flexible coupling 40 is actuated by the positioning cylinder 55 to connect the shaft 41 with the new reel spool. Motor 24 drives the in-shaft 41 via the timing belt 38 through sheaves 28,32 to accelerate the new spool to web speed and to provide driving torque to the new reel spool while winding the beginning portion of the traveling web onto the reel spool at the desired tension.

When the web has been transferred to the new spool via the turn-up apparatus 75, the primary arms begin their rotation in the direction of arrow 74 toward the support rails 68,68'. The newly formed wound web roll is both torqued and nipped to produce the desired roll structure. Since the axis of the platform drive motor is co-axial with the rotational axis of the support drum, and since the platform also rotates co-axially with the primary arms, the flexible coupling 40 can follow the rotation of the reel spool continuously as it moves downwardly toward the support rails. During this rotational movement of the primary arms, the outwardly radial movement of the reel spool as the wound paper web builds up on it is accommodated by pivotal movement of shaft 41 in its coupling 43, as well as axial movement of the outer portion of the shaft about a splined portion 45 of the shaft attached to the coupling 43.

At some point during this arcuate movement of the primary arms, depending on the weight of the built-up paper roll and the desired nip pressure of the wound paper roll against the support drum, the relieving cylinder 9 is activated to relieve the weight of the wound paper roll beyond a certain, predetermined desired limit, so as to maintain the nip pressure of the wound paper roll against the support drum at a desired level due to its weight.

When the primary arms have brought the relatively small diameter, newly formed wound web roll onto the support rails to be supported thereon while maintaining nipping engagement with the support drum, the primary drive on the front side of the roll is deactuated by the positioning cylinder 55, and the secondary drive 58 is actuated to engage the rear end of the reel spool to continue providing driving power and torque to the paper roll as it continues to be wound while engaged in nipping contact with the support drum via the secondary arms while the wound web roll is supported vertically on the substantially horizontally arrayed guide rails 68,68'.

The newly formed wound paper roll is thereby wound under continuous driving torque from the time the on-coming paper web is introduced onto the newly received core in the primary arms until the wound paper roll reaches a desired diameter while it is supported on the substantially horizontally disposed guide rails in the reel. In addition, the nip between the paper roll as it is being wound is controlled during the early stages of the winding process by operation of the pressure cylinders 8,9 in the primary arms.

Since the weight of the platform is supported by the support stand through its bearings, there is very little overhung weight on the reel spool from the time it is received in the primary arms until it is deposited on the supporting guide rails. Then, since the weight of the wound paper roll is supported on the guide rails while the secondary drive is engaged, the over-hung weight on the reel spool and paper roll being wound thereon is also very small since the secondary drive is also supported on its own guide system for lateral movement parallel to the path of travel of the building paper roll supported on the guide rails.

Accordingly, an improved Pope-type reel drive system, which meets the objectives and incorporates the features and advantages of this invention, has been disclosed. Naturally, minor changes in the structure and operation of the invention can be made by the skilled artisan without departing from the spirit and scope of the appended claims.

What is claimed is:

1. Apparatus for reeling a substantially continuous traveling web onto a reel spool to produce a wound web roll, comprising, in combination:

a support drum, having a longitudinal axis of rotation, for engaging the reel spool, on which the web is directed to be wound into a web roll thereon, along a nip line of contact between the support drum and web roll;

a reel for rotatably mounting the support drum, the reel including a pair of spaced, horizontally disposed guide rails for supporting the reel spool, on which the traveling web is wound, radially relative to the support drum;

support drum drive means operatively connected to the support drum for rotatably driving the support drum;

a pair of primary arms pivotally mounted on the reel, co-axially about the support drum, for rotatably mounting a reel spool for receiving the traveling web to be wound into a wound web roll on the reel spool, the primary arms mounted for peripheral movement about an arcuate portion of the support drum surface, beginning at an upper portion of the surface, and traveling downwardly from the upper portion, to deliver the web roll being wound to a predetermined location on the guide rails in the apparatus;

a primary support stand;

a platform, mounted on the primary support stand disposed near one end of the support drum, and mounted for pivotal movement co-axially with the support drum;

in-shaft drive means, including a flexible coupling apparatus, mounted on the platform for arcuate movement therewith about an arcuate portion of the support drum periphery, such that the flexible coupling apparatus can be substantially aligned with the reel spool, to engage the reel spool for receiving the traveling web near or at the upper extent of the peripheral movement of the spool about an arcuate portion over the support drum, and maintain engagement with the reel spool as the reel spool and web roll wound thereon is received on the guide rails, said in-shaft drive means operable to engage the reel spool continuously as the platform pivots with the primary arms about the upper periphery of the support drum and down to the guide rails;

a primary power means non-movably mounted to the primary support stand for rotatably driving the in-shaft drive means.

2. Apparatus for reeling a traveling web onto a reel spool to produce a wound web roll, as set forth in claim 1 further including:

power transmission means mounted on the platform for operatively linking the primary power means and the flexible coupling apparatus, said power transmission means pivotal with the platform and flexible coupling apparatus.

3. Apparatus for reeling a traveling web onto a reel spool to produce a wound web roll, as set forth in claim 2, wherein:

the flexible coupling apparatus includes a universal coupling linked with the power transmission means, and an axially extendable shaft means, whereby radial movement of the coupling apparatus is accommodated as the diameter of the web roll increases as it is wound while maintaining power transmission linkage between the flexible coupling apparatus and the power transmission means.

* * * * *